United States Patent [19]

Bousaid et al.

[11] 3,946,808

[45] Mar. 30, 1976

[54] PROCESS FOR RECOVERING HYDROCARBONS FROM A SUBTERRANEAN RESERVOIR BY IN SITU COMBUSTION

[75] Inventors: Issam S. Bousaid; Marc F. Fontaine, both of Houston, Tex.

[73] Assignee: Texaco Inc., New York, N.Y.

[22] Filed: Feb. 1, 1974

[21] Appl. No.: 438,803

[52] U.S. Cl. ..... 166/245; 166/256; 166/272

[51] Int. Cl.[2] ..... E21B 43/24

[58] Field of Search ..... 166/245, 256

[56] References Cited

UNITED STATES PATENTS 2,914,309 11/1959 Salomonsson ..... 166/256

3,332,480 7/1967 Parrish ..... 166/256

OTHER PUBLICATIONS

Chieh Chu, "Two-Dimensional Analysis of a Radial Heat Wave," J.P.I., 10/63, pp. 1137–1144.

*Primary Examiner*—Stephen J. Novosad
*Assistant Examiner*—George A. Suckfield
*Attorney, Agent, or Firm*—T. H. Whaley; C. G. Ries; Kenneth R. Priem

[57] ABSTRACT

A method for operating an in situ combustion process in a petroleum containing reservoir wherein a plurality of air injection wells are spaced so that the approximate distance between the wells will be twice the distance at which the flux of air to the burning front from a single injection well becomes negligible.

6 Claims, 4 Drawing Figures

○ PRODUCTION WELL

ø INJECTION WELL

IN SITU COMBUSTION AREA

PROCESS FOR RECOVERING HYDROCARBONS FROM A SUBTERRANEAN RESERVOIR BY IN SITU COMBUSTION

BACKGROUND OF THE INVENTION

1. Field of the Invention

This invention relates generally to the production of hydrocarbons from underground hydrocarbon bearing formations by in situ combustion processes.

2. Description of the Prior Art

In order to produce hydrocarbons from permeable underground hydrocarbon bearing formations it is customary to drill one or more boreholes or wells into the hydrocarbon bearing formation and produce the hydrocarbons such as oil through designated production wells either by the natural formation pressure or by pumping the wells. At some point, however, the flow of hydrocarbons diminishes and may even cease even though substantial quantities of hydrocarbons are still present in the underground formations. In other cases the petroleum in the reservoirs is so viscous that it will not initially flow to production wells.

Thus, secondary recovery programs are now an essential part of the overall production planning for every petroleum reservoir in underground hydrocarbon bearing formations after primary production has ceased to be economical. In general, secondary recovery operations involve injecting an extraneous fluid such as water or gas into the hydrocarbon bearing zone to drive the petroleum toward production wells by the process frequently referred to as flooding. Other methods of secondary recovery or even primary recovery involve heating for the recovery of hydrocarbons from the subterranean formation, particularly containing viscous crude and tar sand bitumen. When heated, the hydrocarbon material in the formation becomes less viscous or the chemical composition of the hydrocarbon material is changed to form a material which has a lower viscosity. In either case, the hydrocarbon material in the formation is able to flow more readily through the formation and is recovered from a production or output well. One of these thermal recovery methods involves the combustion of a portion of the hydrocarbon material within the formation. In this method an oxidizing gas (normally oxygen in the form of air) is passed into the formation through an input or injection well and the hydrocarbon material within the formation is ignited by suitable means. This oxidizing gas may be referred to as a combustion supporting gas. The zone of combustion or combustion front produced by the ignition migrates through the formation and the hydrocarbons displaced from the formation by the traveling combustion front are driven through the formation in the direction of the output well. The hydrocarbons enter the output well and they are removed therefrom and brought to the surface of the earth. While this method, termed the in situ combustion method, is satisfactory from the standpoint of the results desired it is subjected to certain drawbacks.

Due to the heat generated within the formation by the in situ combustion process, oxidation reactions at moderate to low temperatures may continue to occur behind the combustion front. This oxidation is a result of injected oxygen in air contacting some of the remaining crude oil or coked hydrocarbons which are usually found behind the combustion front. This reduces the concentration of the combustion supporting gas (oxygen) before it is able to reach the leading edge of the combustion zone or high temperature front. The region behind the front is usually heated to moderate temperatures by the passing combustion front and some areas of this region retain a sufficient amount of hydrocarbons to oxidize a great deal of the combustion supporting gas at these moderate temperatures even after the combustion front has passed. The combustion supporting gas is normally oxygen which may be contained in air or derived from any other source desired.

For a given oxygen injection flux the oxygen concentration reaching the combustion front decreases as the distance from the injection well to the front increases. Inevitably at some distance from the injection well the oxygen flux at the front becomes too small to sustain combustion and the combustion front velocity becomes negligible. At this point the in situ combustion process becomes inefficient as oxygen injection is wasted by the low temperature oxidation and oil is no longer displaced. This condition is reached as the temperature at the front decreases to below a temperature where combustion efficiency for displacing petroleum becomes negligible. As the velocity of the combustion front decreases, the tendency in the past has been to increase the amount of oxygen injected in order to maintain a higher oxygen flux and increase the velocity of the combustion front. However, this soon becomes uneconomical at the higher injection pressure as the ever widening heated combusted zone behind the front consumes more and more injected oxygen. A condition of diminishing returns in the form of an even slower moving combustion front steadily overtakes the injection well's capacity to handle the increased pressure and volumes of oxygen. Also, since more and more oxygen is needed which may not even maintain the velocity of the combustion front, the economics of the in situ combustion process steadily deteriorates and soon becomes prohibitive.

Our invention overcomes these drawbacks by providing for an in situ combustion process with a plurality of combustion supporting gas injection wells spaced so as to anticipate the maximum distance a combustion front will travel. The term "injection wells" as used herein means a geographical injection center containing one or more actual wells or completions equidistant from the injection center.

SUMMARY OF THE INVENTION

A method for operating an in situ combustion process in a petroleum containing reservoir wherein a plurality of air injection wells are spaced so that the approximate distance between the wells will be twice the distance at which the flux of air to the burning front from a single injection well becomes negligible.

DESCRIPTION OF THE PREFERRED EMBODIMENTS

Figure 1:
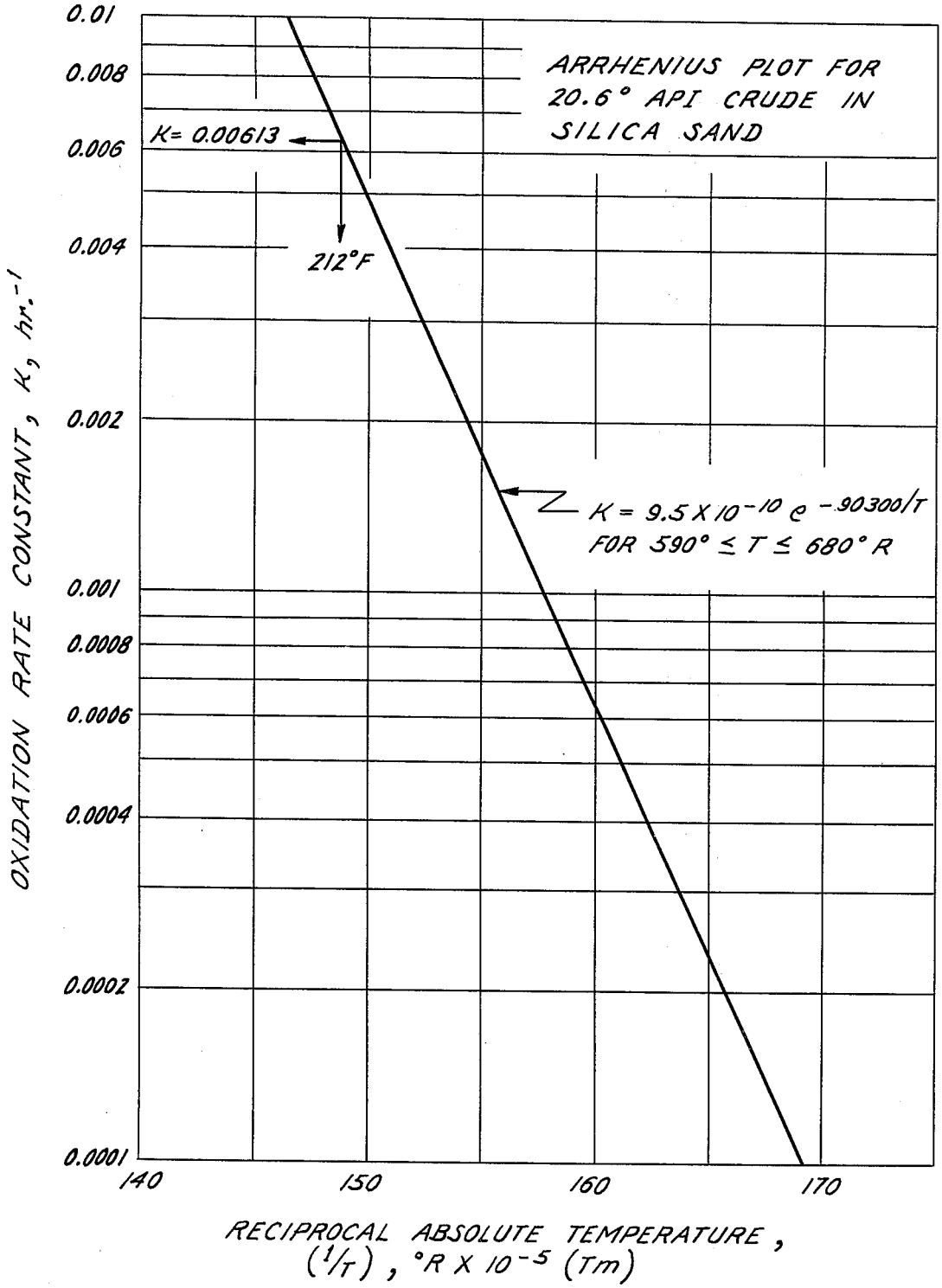
FIG. 1 is an Arrhenius plot for 20.6° API crude in Silica Sand.

As explained above the term "injection well" is used for simplicity. It may refer to a single well or completion, but since only a finite amount of air may be injected through a single completion a plurality of wells or completions fairly close together may be needed. Therefore, the term "injection well" is also intended to encompass a plurality of single wells and denote their geographic center which is deemed to be the point at which air is injected.

Our invention involves determining the maximum distance a combustion front will efficiently travel from a combustion supporting gas injection well and then utilizing this information in order to place additional combustion supporting gas injection wells in the reservoir in order to most efficiently recover oil from that reservoir. The principal advantage of the present invention lies in maximizing the efficiency of an in situ combustion process. Where the maximum distance a combustion front efficiently travels is not known two mistakes are commonly made. Either the combustion supporting injection wells are spaced too closely together, or they are spaced too far apart. In the former instance an excessive number of wells are drilled resulting in higher costs with no additional oil recovery. Combustion areas will intercept each other while they are still expanding, but no further oil will be produced. In the latter case widely spaced injection wells will result in unrecovered pockets of oil which are too small to be economically produced. Once the maximum distance an efficient combustion front will travel is known, options are then available to improve the oil recovery by in situ combustion in that particular reservoir. For example, if a very large reservoir is involved sets of combustion supporting gas injection wells may perhaps be set at a distance from each other approximating twice the distance a combustion front will travel in the reservoir. The additional wells may be added after the original combustion front has ceased to travel outward or the calculations may be made beforehand and all of the wells may be put into operation at once and the combustion operation may be simultaneously begun at a plurality of points in the reservoir. If the aerial extent of the reservoir is small so that it is not practical to place a plurality of wells at twice the maximum combustion front traveling distance, additional injection wells may be placed at a distance equal to or exceeding the combustion front traveling distance in order to sweep a large portion of the field with the fewest possible wells.

The in situ combustion process of our invention may be used in reservoirs containing a wide range of crude oil. The invention may prove especially useful in tar sands such as those found in the McMurry formations in Alberta, Canada.

As mentioned the injected combustion supporting gas, oxygen, for example flow through the burned out area and is partially consumed by low to moderate temperature oxidation reactions before the gas reaches the combustion front. Laboratory studies have shown that the oxidation rates of crude oil at low to moderate temperature, for example, 75°F. to 250°F., are significant. Due to this consumption of oxygen, at some distance from the injection well the oxygen flux will become too small to sustain adequate combustion and the combustion front velocity will become negligible. Oil displacement essentially stops. This condition is reached as the combustion temperature at the front falls below a minimum temperature, Tm. In order to predict this maximum distance where combustion becomes negligible the following equations and their derivation are offered.

DERIVATION OF THE EQUATIONS

The stoichiometric equation for combustion of fuel having an atomic (H/C) hydrogen to carbon ratio equal to $x$ can be expressed by $$CH_x + (1/A)\,O_2 \xrightarrow{\Delta H_c} (1-f)\,CO_2 + (f)\,CO + \left(\frac{x}{2}\right) H_2O \qquad (1)$$

where $\Delta H_c$ is the total heat of combustion, $1/A$ is the mole ratio of oxygen to carbon consumed, and $f$ is the mole fraction of carbon gasified to carbon monoxide $CO/(CO+CO_2)$. From Equation (1), the carbon to oxygen comsumption ratio is given by $$A = \frac{1}{\left(1 - \frac{f}{2} + \frac{x}{4}\right)}, \ \frac{\text{moles of carbon}}{\text{moles of oxygen}}$$

also $$A = \frac{0.031}{\left(1 - \frac{f}{2} + \frac{x}{4}\right)}, \ \frac{\text{lb of C}}{SCF \text{ of } O_2} \qquad (2)$$

The combustion front velocity, $V_f$, at steady-state condition can be expressed by $$V_f = \frac{AF_o}{C}, \text{ ft/hr} \qquad (3)$$

where $F_o$ is the oxygen flux consumed in SCF/(hr-ft$^2$) and $C$ is the carbon concentration consumed at the front in lb/ft$^3$ of rock.

The energy balance between heat of combustion and temperature increase of the reservoir matrix, $\Delta T$, is obtained from the equation, assuming no heat losses. Heat Generated by Combustion = Heat Stored by Matrix $$(\Delta H_o)F_o\,(\text{Area}) = (\rho cp)\,(\text{Volume})\ \frac{\Delta T}{\Delta t}, \text{ Btu/hr} \qquad (4)$$

where $\Delta H_o$ is the heat generated per oxygen volume consumed in Btu/SCF of $O_2$ and $\rho cp$ is the heat content of the rock in Btu/ft$^3$-°F. Also, the reservoir volume within the combustion zone of a finite thickness, $\Delta r$, is $$\text{Volume} = (\text{Area})\,\Delta r$$

then, Equation (4) can be written $$\Delta H_o F_o = \rho cp \left(\frac{\Delta r}{\Delta t}\right) \Delta T$$

but $$V_f = \frac{\Delta r}{\Delta t} = \frac{AF_o}{C} \qquad (5)$$

and Equation (5) becomes $$\Delta H_o \left(\frac{V_f C}{A}\right) = \rho cp\,(V_f)\,\Delta T$$

Therefore, the carbon concentration consumed at the combustion front is obtained from the equation $$C = \frac{\rho cp}{(\Delta H_o/A)}\Delta T \qquad (6)$$

where $(\Delta H_o/A)$ is also equal to $(\Delta H_c/12)$ from Equation (1) in Btu per pound of consumed carbon and $\Delta T = T_f - T_R$ in °F. Equation (6) is used in determining the minimum carbon concentration which corresponds to the minimum front temperature, $T_f = T_M$.

Laboratory experiments concerning low temperature oxidation (LTO) of crude oils have shown that the remaining oxygen concentration in air, $\%O_2$, at any time, $t$, can be expressed by the following equation $$\%O_2 = 21\epsilon^{-Kt} \qquad (7)$$

where $K$ is the oxidation rate constant in $hr^{-1}$ and $t$ is the time of oxidation in hours. This rate constant is related to the oxidation temperature of the crude oil by the equation $$K = a\epsilon^{-b/T} \qquad (8)$$

where $a$ and $b$ are constant obtained from LTO experiments and $T$ is the absolute temperature in °R.

The time, $t$, in Equation (7) can be related to the time for the injected air to reach the combustion front. This time corresponds to the gas velocity or injected air flux, $F_{air}$, within the pore channels. The travel time equation expressed as a function of the radius to the front, $r_f$, is $$t = \frac{r_f}{(F_{air}/\phi)}, \text{ hours} \qquad (9)$$

where $$F_{air} = \frac{V_I}{2\pi\, hr_f(24)}, \; SCF/(\text{hr-ft}^2) \qquad (10)$$

and $V_I$ = air injection rate in SCF/day $h$ = sand formation thickness in feet $r_f$ = radius from the injection well to the front in feet $\phi$ = formation porosity; fraction of rock volume Combining Equations (7), (9), and (10), the front radius, $r_f$, from the air injection well(s) is calculated below $$t = \frac{r_f}{\left(\frac{V_I}{48\, hr_f\phi}\right)} = -\frac{1}{K}\ln\left(\frac{\%O_2}{21}\right)$$

and solving for $$r_f = \left[\frac{V_I \ln(21/\%O_2)}{48\,\pi\, h\phi K}\right]^{1/2} \text{feet} \qquad (11)$$

The above Equation (11) is used to calculate the front radius for a given field condition. Most of the parameters in Equation (11) are usually known with exception of the oxygen concentration at the front, $\%O_2$, and the oxidation rate constant, $K$. This information is obtained from results of LTO experiments and composition of the produced gas of the in situ combustion field project. Also, the average formation temperature behind the combustion front is needed to calculate the oxidation rate constant from Equation (8). This information is not always available, and both $K$ and $\%O_2$ in Equation (11) can be estimated from field data obtained during steady-state combustion of the project. In this case, the following equations are used to calculate the minimum oxygen concentration as a function of the minimum carbon concentration, $C_m$ $$(\%O_2)_m = \frac{(\%O_2)_{ss}}{C_{ss}} C_m \qquad (12)$$

where $$C_m = \frac{\rho c_p}{(\Delta H_c/12)}(T_M - T_R), \text{ lb/ft}^3 \text{ rock}$$

and $(\%O_2)_{ss}$ and $C_{ss}$ are the oxygen and carbon concentration consumed at steady-state combustion, respectively. These values are obtained from field or laboratory results of in situ combustion. The oxygen utilization of the injected air is often used to determine the steady-state oxygen concentration at the front $$(\%O_2)_{ss} = \frac{21}{100}(\%O_2) \text{ utilization}$$

The oxidation rate constant behind the front can be estimated from the reservoir volume burned to the front under steady-state conditions. Equation (11) is used for this period as shown below:

$$K = \frac{V_I \ln(21/(\%O_2)_{ss})}{48\,\pi\, hr_f\phi^2}, \; hr^{-1} \qquad (13)$$

The oxidation rate constant calculated from Equation (13) for steady-state combustion can also be used in Equation (11) for determining the maximum radius to the front. Also, the minimum oxygen concentration is obtained from Equation (12). It is assumed that the average oxidation temperature behind the front remains constant during these periods of combustion. In addition, the rate constant can be used in Equation (8) to calculate the average temperature of the coked formation behind the combustion front.

FIELD EXAMPLE

A large oil field is to be subjected to in situ combustion to recover the oil present in the reservoir. In order to insure that the combustion patterns sweep the maximum portion of the field the radius from each air injection well that a combustion front will efficiently move is calculated.

FIELD CALCULATION

The calculations are based on the following field and laboratory results for an actual reservoir after a pilot in situ combustion flood.

FIELD DATA

Formation Sand Thickness, $h = 8$ feet
Formation Porosity, $= 0.33$
Reservoir Temperature, $T_R = 80°F$.
Formation Heat Content, $\rho cp = 26$ Btu/ft$^3$-°F.

STEADY-STATE COMBUSTION DATA

Avg. Air Injection Rate, $V_I = 4.75 \times 10^6$ SCF/day
Avg. Reservoir Vol. Burned, $V_B = \pi h r_f^2 = 402$ Acre-ft.
Carbon Concentration Consumed, $C_{ss} = 0.80$ lb/ft$^3$-rock
Avg. Oxygen Utilization, $(O_2)$ utilization = 70%

LABORATORY DATA

LTO experiments (FIG. 1) give the oxidation rate constant, $K = a\ e^{-b/T}$, hr$^{-1}$
$a = 9.5 \times 10^{10}$
$b = 20{,}300$
$\Delta H_o = 476$ Btu/SCF $O_2$
$A = 0.0238$ lb C/SCF $O_2$
$\Delta H_c/12 = 20{,}000$ Btu/lb C
Minimum Combustion Temperature, $T_M = 450°F$.
$\Delta T_m = T_M - T_R = 370°F$.

The steady-state oxygen concentration at the combustion front at a given point in time in the field is estimated by $$(\%O_2)_{ss} = 21/100\ (70) = 14.7$$

and the formation volume burned to that time is $$\pi\ h(r_f)_{ss}^2 = 402(43560) = 17.5 \times 10^6,\ \text{ft.}^3$$

and $$(r_f)_{ss} = 835\ \text{ft.}$$

Then, the oxidation rate constant is calculated from Equation (13).

$$K = \frac{4.75 \times 10^6 \ln (21/14.7)}{48(17.5 \times 10^6)(0.33)} = 0.00613,\ \text{hr}^{-1}$$

Using this oxidation rate constant in FIG. (1), the average temperature of the coked formation behind the front is 212°F. the minimum temperature increase, $\Delta T_m$, is used in Equation (6), and the minimum carbon concentration is $$C_m = \frac{26}{20{,}000}(370) = 0.48\ \text{lb/ft.}^3$$

This value corresponds to a minimum oxygen concentration at the front calculated from Equation (12)

$$(\%O_2)_m = \frac{14.7}{0.80}(0.48) = 8.8$$

This oxygen concentration value is used in Equation (11) to calculate the distance to the combustion front at which time combustion becomes negligible under the given field conditions. Thus, the maximum front radius is $$r_f = \left[\frac{4.75 \times 10^6 \ln (21/8.8)}{48\ \pi\ (8)\ (.33)\ (0.00613)}\right]^{1/2} = 1300\ \text{feet}$$

This distance from the air injection well(s) to the combustion front corresponds to an average front radius at which time combustion is too small to sustain an efficient front.

Figure 2:
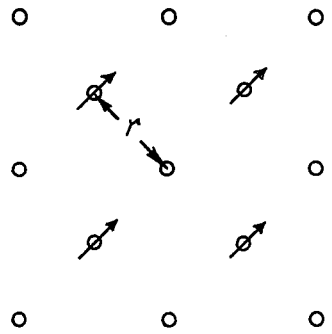
FIG. 2 depicts a typical drilling pattern for the invention.
Figure 3:
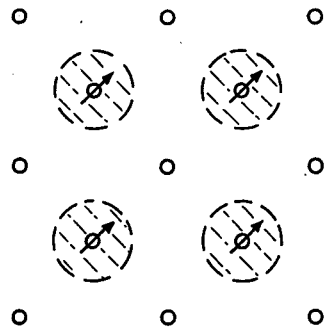
FIG. 3 depicts in situ combustion fronts expanding outward from each injection well.
Figure 4:
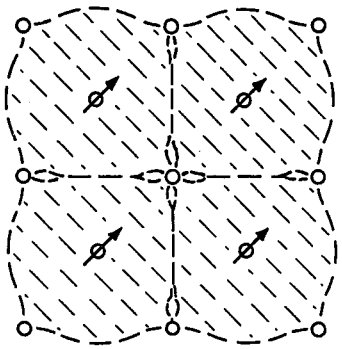
FIG. 4 depicts the area swept by the combustion fronts at the end of an in situ combustion operation.

Using the information thus generated, FIGS. 2–4 illustrate the development of the field for a full scale in situ combustion process. FIG. 2 depicts the drilling pattern to be used based on the radius of 1300′ calculated above. As shown, the production wells are preferably placed 1300 feet from the injection wells. If multiple injection wells are used as shown, the production wells should be placed about equidistance between opposite injection wells. This is of course, limited to the case where the reservoir is large enough in areal extent to place production wells a distance $r_f$ from all injection wells. Where a smaller reservoir is encountered, production wells may be placed at a distance $r_f$ from an injection well and, if desired, other injection wells may be placed as far from the production wells as possible not to exceed the distance $r_f$. The wells are drilled and FIG. 3 depicts the in situ combustion patterns as they travel outward from the injection wells. FIG. 4 depicts the area swept at the end of the in situ combustion flood is the maximum area which can be swept without either excessive overlapping or unswept areas.

We claim:

1. A method for producing hydrocarbons from an underground hydrocarbon-bearing formation involving injection wells and production wells wherein a combustion supporting gas is introduced into the injection wells and the hydrocarbons are ignited in situ around the injection wells in order to propagate a combustion front radiating from the injection wells so that hot gases are generated to force hydrocarbons to the production wells the improvement which comprises determining the distance at which the flux of the combustion supporting gas becomes negligible by the formula $$r_f = \left[\frac{V_I \ln (21/\%O_2)}{48\ \pi\ h\ \phi\ K}\right]^{1/2}$$

wherein $V_I$ = air injection rate in SCF/day
$h$ = sand formation thickness, Feet
$\phi$ = formation porosity, fraction of rock volume
$K$ = oxidation rate constant, hr$^{-1}$ and placing production wells at said distance $r_f$ from said injection wells.

2. A method as in claim 1 wherein the combustion supporting gas is oxygen contained in air.

3. A method as in claim 1 wherein the hydrocarbons are tar sand bitumen.

4. A method of producing hydrocarbons from an underground hydrocarbon-bearing formation containing a first injection well and one or more producing wells spaced some distance from the injection well comprising injecting a combustion supporting gas into the injection well, igniting the hydrocarbons around the injectin well to form a moving burning front which causes the hydrocarbons ahead of the front to migrate away from the injection well and toward the production well, determining the distance the burning front moves before the flux of combustion supporting gas to the front becomes negligible, placing additional injection wells at a distance from the first injection well equal to approximately twice the distance traveled by the burning front before the flux of combustion supporting gas becomes negligible, placing additional production wells at some distance from the additional injection wells, injecting a combustion supporting gas into the additional injection wells, igniting the hydrocarbons around the additional injection wells, and producing hydrocarbons from the additional production wells.

5. A method as in claim 4 wherein the combustion supporting gas is oxygen contained in air.

6. A method as in claim 4 wherein the hydrocarbons are tar sand bitumen.

* * * * *